US006029915A

United States Patent [19]

Inoue

[11] Patent Number: 6,029,915

[45] Date of Patent: Feb. 29, 2000

[54] GRINDING AND DISPERSING METHOD AND APPARATUS

[75] Inventor: Masakazu Inoue, Tokyo, Japan

[73] Assignee: Inoue Mfg., Inc., Japan

[21] Appl. No.: 09/191,887

[22] Filed: Nov. 13, 1998

[30] Foreign Application Priority Data

Mar. 3, 1998 [JP] Japan ..... 10-066096

[51] Int. Cl.[7] ..... B02C 17/16

[52] U.S. Cl. ..... 241/17; 241/24.11; 241/27; 241/65; 241/172; 241/199.12

[58] Field of Search ..... 241/46.17, 65, 241/74, 172, 199.12, 179, 15, 17, 16, 21, 24.11, 27

[56] References Cited

U.S. PATENT DOCUMENTS

| | | | |
|---|---|---|---|
| 5,024,387 | 6/1991 | Yeh | 241/21 |
| 5,114,083 | 5/1992 | Ikebuchi et al. | 241/153 |
| 5,199,656 | 4/1993 | Szegvari et al. | 241/171 |
| 5,497,948 | 3/1996 | Hockmeyer | 241/46.17 |

FOREIGN PATENT DOCUMENTS

| | | |
|---|---|---|
| 58-174230 | 10/1983 | Japan . |
| 60-48126 | 3/1985 | Japan . |
| 1210020 | 8/1989 | Japan . |
| 2207853 | 8/1990 | Japan . |
| 372932 | 3/1991 | Japan . |
| 686924 | 3/1994 | Japan . |

*Primary Examiner*—John M. Husar
*Attorney, Agent, or Firm*—Adams & Wilks

[57] ABSTRACT

A grinding and dispersing apparatus comprises a tank for storing a liquid containing a material to be treated and a container disposed in the tank for containing grinding media. The container has an inlet for receiving the liquid containing the material and a discharge outlet for discharging the liquid containing the material. A feeding mechanism is disposed at the inlet of the container for feeding the liquid containing the material into the container. A stirring mechanism extends into the container for stirring the grinding media and the liquid containing the material fed into the container to disperse the material in the liquid. A separating device is disposed at the discharge outlet of the container for separating the grinding media from the liquid containing the dispersed material and permitting the liquid containing the dispersed material but not the grinding media to be discharged from the container.

48 Claims, 2 Drawing Sheets

GRINDING AND DISPERSING METHOD AND APPARATUS

BACKGROUND OF THE INVENTION

1. Field of the Invention

The present invention relates generally to a grinding and dispersing method and apparatus and, more particularly, to an improvement in basket mills in which a material to be treated having solid constituents is finely ground and dispersed in a liquid using grinding media.

2. Background Information

Basket mills are apparatuses by which a material to be treated (mill base) is ground and dispersed in a concentrated manner using a small amount of grinding media. Grinding and dispersing apparatuses of this type are described in, for example, JP-B-59-46665 (JP-A-58-174230), JP-B-62-16687 (JP-A-60-48126) and JP-B-5-82253 (JP-A-1-210020). However, in the grinding and dispersing apparatuses disclosed in these publications, a container containing dispersing media is used as a basket which is disposed in a tank containing the material to be treated, and a stirring shaft connected to a bearing passes through a hole at a bottom portion of the basket and extends downwardly from the basket. Accordingly, in the foregoing conventional apparatuses, there is the possibility that the material to be treated clogs a trunk portion of the basket, the grinding media clogs the hole at the bottom of the basket through which the stirring shaft extends, the basket is subjected to degradation due to heat generation during grinding and dispersion of the material to be treated, and the basket and stirring shaft bearing are subjected to abrasion causing the grinding media to flow into the tank.

Conventional grinding and dispersing apparatuses wherein a stirring shaft does not extend downwardly through a bottom portion of a container disposed within a tank are disclosed in, for example, JP-A-2-207853, JP-B-6-73620 (JP-A-6-86924). In such apparatuses, a rotor is disposed at the bottom portion of the container, and a gap is formed between a lower end face of the container and the rotor to allow only the material to be treated to flow out of the gap. Furthermore, in a conventional grinding and dispersing apparatus disclosed in JP-B-8-17930 (JP-A-3-72932), a bottom of a container is formed as a blind bottom panel, and only a material to be treated is allowed to flow out of small pores disposed at side walls of the container. In these conventional apparatuses, however, there is a tendency toward clogging and/or heat generation, and the circulation of the material to be treated within the container sometimes becomes inadequate.

Other conventional apparatuses of the type set forth above provide a jacket disposed in a container within a tank to eliminate the generation of heat, as described in JP-A-56-37057 and Utility Model JP-A-4-87742 (Utility Model No. 2515678). In these conventional apparatuses, a partition such as a screen is disposed at each of both sides (upper and lower sides) of the container to form a space containing grinding media within the container, and blades of an axial flow pump are attached to a stirring shaft which extends towards the outside (lower side) of the screen to allow flow of the material to be treated. Accordingly, these conventional apparatuses still suffer from problems of clogging and outflow of the grinding medium at portions of the container where the stirring shaft passes through the screen, and the material to be treated does not adequately flow in or flow out of the space containing the grinding media.

Moreover, other conventional grinding and dispersing apparatuses are constructed so that a container is positioned within a tank, and stirring blades for stirring a fluid are disposed at a lower portion of the container, whereby a material to be treated will flow from the lower portion toward an upper portion of the container, and the material to be treated enters the container at a central portion of the tank. In such apparatuses, the material to be treated is not fed directly into the container, thereby making the feeding process of the material to be treated uncertain.

SUMMARY OF THE INVENTION

In order to overcome the foregoing drawbacks in the conventional art, it is an object of the present invention to provide a grinding and dispersing method by which a container containing grinding media is placed in a tank containing a liquid and material to be treated having solid constituents, and by which the material to be treated is permitted to flow into and out of the container to be finely ground and dispersed in the liquid. According to the present invention, during grinding and dispersion of the material to be treated, heat generation of the container is suppressed, the material to be treated moving within the tank can flow into and out of the container with good efficiency, and problems associated with clogging or outflow of the dispersing medium are eliminated.

Another object of the present invention is to provide a grinding and dispersing apparatus for carrying out the grinding and dispersing method.

The foregoing and other objects of the present invention are carried out by a grinding and dispersing method comprising the steps of storing a liquid containing a material to be treated in a tank, storing a grinding media in a container, immersing the container in the tank, drawing the liquid containing the material to be treated into the container, moving the grinding media and the liquid containing the material to be treated to grind and disperse the material to be treated in the liquid, and discharging only the liquid containing the dispersed material from a discharge outlet of the container while separating the grinding media from the liquid containing the dispersed material.

According to the present invention, the drawing step preferably comprises feeding the liquid containing the material to be treated in the tank into the container using a feeding screw, and the moving step preferably comprises rotating a plurality of stirring blades disposed in the container. During the discharging step, the grinding media is separated from the liquid containing the dispersed material by a separating device. The separating device preferably comprises a filter member disposed at the discharge outlet of the container, and the separating step includes using the filter member to allow only the liquid containing the dispersed material to be discharged from the discharge outlet of the container.

The grinding and dispersing method according to the present invention includes the steps of circulating the liquid containing the material to be treated within the tank, and circulating the liquid containing the dispersed material through the tank and the container while repeating the moving step until the material is ground and dispersed to a preselected degree.

In another aspect, the present invention is directed to a grinding and dispersing apparatus comprising a tank for storing a liquid containing a material to be treated and a container disposed in the tank for containing grinding media. The container has an inlet for receiving the liquid containing the material and a discharge outlet for discharging the liquid containing the material. A feeding mechanism is disposed at the inlet of the container for feeding the liquid containing the material into the container. A stirring mechanism extends into the container for stirring the grinding media and the liquid containing the material fed into the container to disperse the material in the liquid. A separating device is disposed at the discharge outlet of the container for separating the grinding media from the liquid containing the dispersed material and permitting the liquid containing the dispersed material but not the grinding media to be discharged from the container.

The container preferably has a waterproof peripheral wall portion. A jacket is disposed over the peripheral wall portion of the container for receiving a temperature-controlling fluid to control the temperature of the liquid containing the material to be treated.

The grinding and dispersing apparatus according to the present invention preferably includes a removable cover disposed at the inlet of the container. The removable cover has an aperture through which the liquid containing the material is fed into the container by the feeding mechanism. The feeding mechanism extends into the container through the aperture of the removable cover.

The stirring mechanism preferably comprises a rotational shaft extending through the aperture of the removable cover, and at least one rotationally driven element disposed in the container and integrally connected to the rotational shaft for rotation therewith. The feeding mechanism is integrally connected to the rotational shaft for rotation therewith.

In another embodiment, the at least one rotationally driven element comprises a plurality of rotationally driven elements. A set of the plurality of rotationally driven elements are disposed closer to the filter member than the other rotationally driven members and have a pitch which, during rotation, cause the grinding media in the container to move up towards the other rotationally driven members.

In another embodiment, the filter member comprises a base portion defining a base of the container, and peripheral sections extending from the base portion and connected to the container. Each of the peripheral sections of the filter member has a length equal to or, preferably, less than ⅓ of the height of the container. A holding frame is preferably integrally connected to the container for removably supporting the filter member, the peripheral sections of the filter member being connected to the holding frame.

In another embodiment, at least one stirring mechanism extends into the tank for circulating the liquid containing the material within the tank. The stirring mechanism is disposed between the container and an inner wall surface of the tank. Preferably, the stirring mechanism extending into the tank comprises a rotational shaft extending into the tank, and rotationally driven elements disposed in the tank and integrally connected to the rotational shaft for rotation therewith.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

While this invention is susceptible of embodiments in many different forms, this specification and the accompanying drawings disclose only preferred embodiments of the invention. The invention is not intended to be limited to the embodiments so described, and the scope of the invention will be pointed out in the appended claims.

The preferred embodiments of the present invention will be described below with reference to FIGS. 1–2, wherein like numerals designate like elements throughout the figures.

Figure 1:
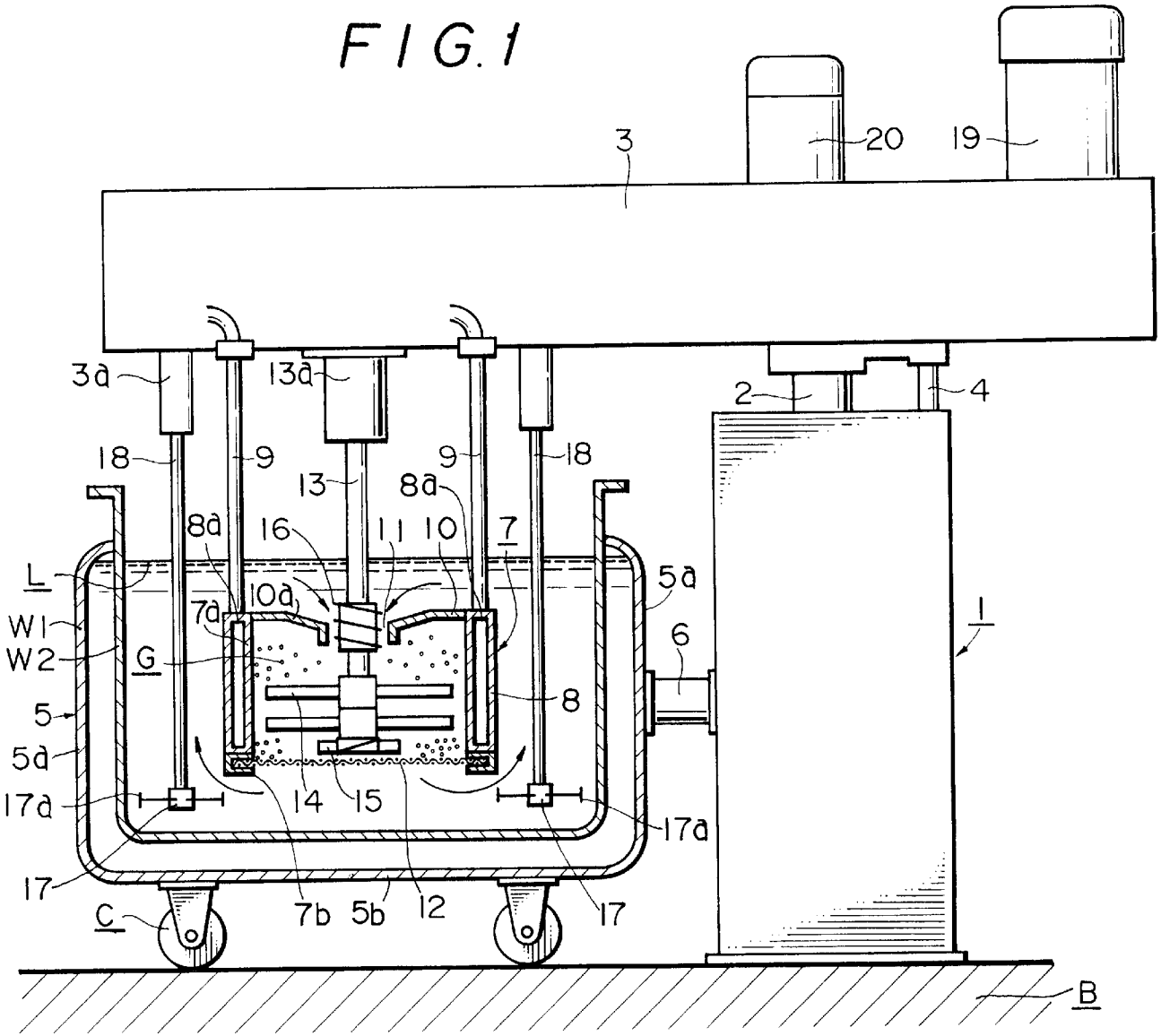
FIG. 1 is a side view in partial cross section of an embodiment of the grinding and dispersing apparatus according to the present invention.

FIG. 1 shows an embodiment of the grinding and dispersing apparatus according to the present invention. A support member or main body 1 is supported on a fixed base B. An elevating shaft 2 is supported by the main body 1 for extension from and retraction into the main body. For example, the elevating shaft 2 may be actuated by a fluid pressure cylinder (not shown) disposed within the main body 1. In the embodiment shown in FIG. 1, extension of the elevating shaft 2 is directed in an upward direction (i.e., away from the main body 1), and retraction of the elevating shaft 2 is directed in a downward direction (i.e., towards the main body 1).

A base member or frame 3 is supported and can be lifted or lowered by the elevating shaft 2 relative to the main body 1 along a guide member or shaft 4. A tank 5 for storing a liquid L containing a material to be treated is disposed below the frame 3 and is supported on the fixed base B. The tank 5 is provided at a lower end thereof with an outlet port (not shown) through which the contents of the tank 5 can be drained as desired. In another embodiment, the tank 5 does not have an outlet port, and the contents of the tank 5 can be removed from an open end thereof by tilting the tank 5. The tank 5 is attached to the main body 1 by a connecting member 6 which connects the main body 1 with one of side wall portions 5*a* of the tank 5. By this construction, the tank 5 is maintained in a fixed position below the frame 3 during a grinding and dispersing operation. The tank 5 is preferably supported on casters C for movement along the fixed base B prior to or after, for example, the grinding and dispersion operation.

In the embodiment of FIG. 1, the tank 5 has a double-wall construction. An outer peripheral wall W1 defined by the side wall portions 5*a* and a bottom wall portion 5*b* surrounds an inner peripheral wall W2 containing the liquid L. The outer peripheral wall W1 functions as a jacket for the introduction of a temperature-controlling medium, such as cooling water, for cooling the materials being processed within the inner peripheral wall W2. The temperature-controlling medium is circulated around the jacket from an inlet to an outlet thereof (not shown). It will be understood by those skilled in the art, however, that the present invention can also be practiced with the tank 5 having a single-wall construction.

It will also be understood by those skilled in the art that various alternative connecting means (not shown), other than as shown in FIG. 1, may be provided for maintaining the tank 5 in a fixed position below the frame 3 during a grinding and dispersion operation. For example, the main body 1 can be provided with an arm portion and an eyebolt attached to the arm portion for engagement with a flange mounted on the side wall portion 5*a* of the tank. In another embodiment, the main body 1 can be provided with an arm which surrounds the tank 5, and the arm and the tank 5 are then connected using a chain. Alternatively, the tank 5 can be disposed between two main bodies each having a hydraulic or manual clamp for clamping the tank 5.

A container 7 having a generally cylindrical configuration for containing grinding media G is selectively inserted into the tank 5 through the open end thereof so as to be immersed in the contents of the tank 5. As an example, the grinding media G may comprise beads made from any suitable material, such as glass, ceramic, plastic, metal or any other high density material. The container 7 has peripheral side wall portions 7*a* which are imperforate and which are preferably constructed from a waterproof material. A jacket 8 surrounds the side wall portions 7*a* and has inlets 8*a* for the introduction of a temperature-controlling medium, such as cooling water, for cooling the materials being processed within the tank 5 and the container 7 which tends to be heated during the grinding and dispersing operation. The temperature-controlling medium is introduced into and withdrawn from the jacket 8 through conduits or pipelines 9 which are connected at one end in fluid communication with the inlets 8*a* of the jacket 8 and are connected at an opposite end in fluid communication with a temperature-controlling medium source (not shown).

The pipelines 9 are integrally connected to and extend from a lower surface 3*a* of the frame 3 and also function as stays for interconnecting the container 7 with the frame 3. By this construction, the container 7 can be immersed into or removed from the tank by lowering and lifting, respectively, the frame 3 relative to the main body 1 along the guide shaft 4, and the container 7 can be mounted in a secure, fixed position within the tank 5.

A removable cover 10 has a generally plate shape formed with a central aperture 11 and is disposed at an open upper end of the container 7 to prevent the grinding media from flowing out of the upper end of the container. The cover 10 has a peripheral portion 10*a* surrounding the aperture 11 which converges into the container 7. It will be appreciated by those of ordinary skill in the art that the inclusion of the cover 10 is optional, and that the container 7 may be used in the grinding and dispersing apparatus without the cover 10, depending upon the nature of the material being treated.

A separating device 12 is provided at a lower open end of the container 7 for separating the grinding media G from the dispersed material. In the present embodiment, the separating device comprises a screen system in the form of a generally planar-shaped filter member 12 having slits, pores or mesh openings, through which the material to be treated but not the grinding media G may pass. Stated otherwise, the relative dimensions of the grinding media G and the slits, pores or mesh openings of the filter member 12 are such that the grinding media G cannot fit through the filter member and is retained in the container 7. The filter member 12 defines a base of the container 7 and is detachably supported by a holding frame 7*b* integral with the lower open end of the container 7. The filter member 12 can be replaced with other filter members having suitably dimensioned slits, pores or mesh openings depending on the particle size of the grinding media selected for the grinding and dispersing operation.

A stirring mechanism extends into the container 7 for stirring the grinding media G and the liquid L containing the material to be treated to disperse the material in the liquid. The stirring mechanism comprises a rotational drive member or shaft 13 and rotationally driven elements 14, 15 integrally connected to the drive shaft 13 for rotation therewith. The drive shaft 13 extends axially through the opening 11 of the cover 10 and into the container 7 but not through the filter member 12. The drive shaft 13 extends downwardly from the lower surface 3*a* of the frame 3 and is supported for rotation within a bearing (not shown) carried by a support member 13*a*. The rotationally driven elements 14, 15 preferably comprise stirring blades which are integrally mounted at an end of the drive shaft 13 disposed inside of the container 7 and which extend radially outwardly from the drive shaft 13 into the grinding media G. Preferably, the stirring blades 15, (i.e., the lowest stirring blades as shown in FIG. 1), which are closer to the filter member 12 than stirring blades 14, have a pitch which, during rotation, cause the grinding media G to move upwardly towards the other stirring blades 14. By this construction, during rotation of the stirring blades 14, 15 by the drive shaft 13, the grinding media G is caused to move with a random up and down motion, rather than moving as a mass only in a rotational motion, and the desired grinding action is enhanced. Additionally, any tendency toward packing of the grinding media G is reduced and clogging of the slits, pores or mesh openings of the filter member 12 is significantly reduced.

A feeding mechanism 16 is provided at the opening 11 of the cover 10 for feeding the liquid L containing the material to be treated through the opening 11 of the cover 10 and into the container 7. The feeding mechanism 16 is coupled to the drive shaft 13 for rotation therewith. Rotation of the feeding mechanism 16 establishes a pressure differential which raises the pressure at the opening 11 of the cover 10, thereby enhancing the flow of the liquid L containing the material to be treated through the container 7 while assisting in the appropriate agitation of the grinding media G for optimum grinding and dispersion of the material to be treated within the liquid L in the tank 5. Preferably, the feeding mechanism 16 comprises a feeding screw. However, other mechanisms for feeding the liquid L containing the material to be treated into the container 7, such as a feeding blade and the like, are suitable.

In order to improve circulation of the liquid L containing the material to be treated through the tank 5, a pair of stirring mechanisms 17 are disposed within the tank 5 closely adjacent to the lower end of the container 7. Preferably, the container 7 is disposed between the stirring mechanisms 17. Each of the stirring mechanisms 17 has a set of stirring blades 17*a* coupled for rotation with a drive shaft 18 which extends downwardly from the lower surface 3*a* of the frame 3. The stirring blades 17*a* improve the flow of the material to be treated along a circuit depicted by the arrows in FIG. 1. Furthermore, movement of the material to be treated by the stirring blades 17*a* increases agitation within the tank 5, outside of the container 7, and impedes adherence of the material to the inner walls of the tank 5, thereby reducing the need for periodic scraping of the inner walls and reducing maintenance requirements.

In the embodiment shown in FIG. 1, rotating shafts 13 and 18 are preferably actuated by driving motors 19, 20. Although three stirring blades 14, including the stirring blade 15, are carried by the drive shaft 13, it will be understood by those of ordinary skill in the art that the number of stirring blades may be varied depending on the dimensions of the container 7, the material being treated, and the desired grinding and dispersing treatment. Furthermore, the distance between the respective stirring blades 14 and the distance between each stirring blade and the inner wall of the container 7 is suitably selected and maintained in relation to the size of the grinding media G to ensure that the grinding media G does not become jammed or cause breakage of any parts during operation of the grinding and dispersing apparatus. Likewise, although two stirring mechanisms 17 are disposed in the tank 5, one stirring mechanism or three or more stirring mechanisms equally spaced around the container 7 may be provided for improving the circulation of the material to be treated.

It will be appreciated from the construction of the grinding and dispersing apparatus according to the foregoing embodiment of the present invention that an increased volumetric flow of the material to be treated is achieved. As a result of the increased volumetric flow, the rate at which the material to be treated is circulated through the container 7, and through the grinding media G in the container 7, is increased, thereby allowing for a more rapid grinding and dispersion of the solid constituents of the material to be treated as compared to the conventional art.

Figure 2:
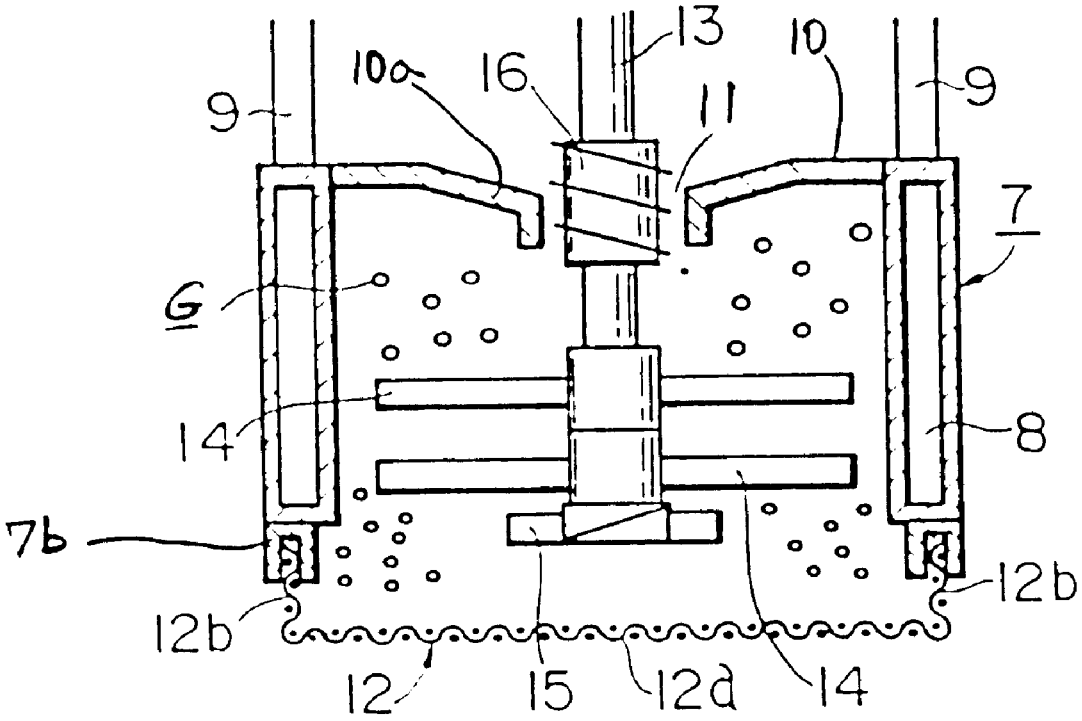
FIG. 2 is a partial cross-sectional view of another embodiment of the grinding and dispersing apparatus according to the present invention.

Another embodiment of the grinding and dispersing apparatus according to the present invention, as shown in FIG. 2, comprises all of the elements described above with respect to the embodiment of FIG. 1. However, in the embodiment of FIG. 2, the filter member 12 is generally basket-shaped instead planar-shaped. More specifically, the filter member 12 has a base portion 12*a* defining the base of the container 7, and peripheral sections 12*b* extending from the base portion 12*a* and detachably connected to the holding frame 7*b*. The length of each of the peripheral sections 12*b* of the filter member 12 is equal to or, preferably, less than ⅓ of the height of the container 7. By this construction, the flow of the material to be treated is further enhanced, the cooling effect provided by the jacket 8 is further enhanced, and detrimental effects such as wearing and abrasion of the components are reduced.

During a grinding and dispersion treatment according to the present invention, the tank 5 containing the material to be treated is positioned below the frame 3 while the frame is in the elevated position so that the container 7 and drive shafts 13, 18 are disposed over the open end of the tank 5. The tank 5 is then integrally attached to the main body 1 by the connecting member 6. The elevating shaft 2 is then activated to lower the frame 3 along the guide shaft 4 to insert the stirring blades 14, 15, 17*a* and the container 7 through the open end of the tank 5 so as to be immersed in the contents of the tank 5. The cover 10 and the filter member 12 are assembled on the container 7 in an operation prior to lowering the frame 3.

Thereafter, the driving motors 19, 20 are actuated to rotate the drive shafts 13, 18, thereby rotating the feeding mechanism 16 and the stirring blades 14, 15 and 17*a*, via a rotation-transfer mechanism (not shown). By the rotation of the feeding mechanism 16 and the stirring blades 14, 15 and 17*a*, the liquid L containing the material to be treated is circulated inside of the tank 5 and through the container 7 along the flow path depicted by the arrows in FIG. 1. While passing through the container 7, the solid constituents of the material to be treated are finely ground by the grinding media G, dispersed in the liquid and then discharged from the container 7 through the filter member 12. The circulation of the material to be treated through the container 7 is continued until the material to be treated is ground and dispersed to a predetermined desired state.

As described above, an increased volumetric flow of the materials being processed is achieved by the structure of the grinding and dispersing apparatus according to the present invention. As a result of the increased volumetric flow, the rate of grinding and dispersing is increased and there may tend to be a rise in the temperature within the tank 5 and the container 7. In order to guard against any degradation which might ensue from a temperature rise in the material to be treated, a coolant is introduced into the jacket 8 via the pipelines 9 and jacket inlets 8*a* and is circulated in the jacket 8 to cool the materials being processed. Alternatively, depending upon the material to be treated, a temperature-controlling medium comprising a heated fluid may be circulated through the jacket 8 such as, for example, where it is desired to increase the temperature of the material to be treated.

By the improved grinding and dispersing method and apparatus according to the present invention, the following advantages are obtained: (1) The rate at which the material to be treated is circulated through the container, and through the grinding media in the container, is increased, thereby providing more rapid grinding and dispersion of the solid constituents in the material to be treated; (2) the dispersion of more solid constituents of the material to be treated is achieved in less time; (3) the efficiency with which the solid constituents in the material to be treated are ground and dispersed in the liquid is increased, thereby reducing energy requirements; and (4) clogging, wear, abrasion and other detrimental effects are substantially reduced, thereby attaining a more effective grinding and dispersing treatment.

Moreover, since the drive shaft and/or the stirring blades supported for rotation by the drive shaft do not pass through the filter member, clogging and outflow of the grinding media from the container is effectively prevented. Furthermore, even when there is a rise in temperature in the tank and/or the container due to an increase in the volumetric flow of the materials being processed, a coolant can be efficiently introduced into and circulated in the jacket surrounding the container to cool the materials being processed.

By providing the stirring blade which is disposed inside of the container and which is closest to the filter member with a pitch which, during rotation, causes the grinding media to move up towards the other stirring blades disposed inside of the container, the flow and grinding action of the material to be treated is enhanced. Additionally, any tendency toward packing of the grinding media is reduced and clogging of the slits, pores or mesh openings of the filter member is reduced.

By disposing stirring blades within the tank and at positions closely adjacent to the lower end of the container, the flow of the material to be treated is further improved. Furthermore, movement of the material to be treated by the stirring blades increases agitation within the tank, outside of the container, and impedes adherence of the material to the inner walls of the tank, thereby reducing the need for periodic scraping of the inner walls and reducing maintenance requirements.

From the foregoing description, it can be seen that the present invention provides an improved grinding and dispersing method and apparatus. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed is:

1. A grinding and dispersing apparatus comprising: a tank for storing a liquid containing a material to be treated; a container disposed in the tank for containing grinding media, the container having an inlet for receiving the liquid containing the material and a discharge outlet for discharging the liquid containing the material; a feeding mechanism disposed at the inlet of the container for feeding the liquid containing the material into the container; a stirring mechanism for stirring the grinding media and the liquid containing the material fed into the container to disperse the material in the liquid, the stirring mechanism having a rotational shaft extending into the container but not through the discharge outlet of the container; and a separating device disposed at the discharge outlet of the container for separating the grinding media from the liquid containing the material and permitting the liquid containing the material but not the grinding media to be discharged from the container.

2. A grinding and dispersing apparatus according to claim 1; further comprising a jacket disposed over a peripheral wall portion of the container for receiving a temperature-controlling fluid to control the temperature of the liquid containing the material.

3. A grinding and dispersing apparatus according to claim 2; wherein the peripheral wall portion of the container is waterproof.

4. A grinding and dispersing apparatus according to claim 2; wherein the peripheral wall portion of the container is imperforate.

5. A grinding and dispersing apparatus according to claim 1; further comprising a removable cover disposed at the inlet of the container, the removable cover having an aperture through which the liquid containing the material is fed into the container by the feeding mechanism.

6. A grinding and dispersing apparatus according to claim 5; wherein the feeding mechanism extends through the aperture of the removable cover.

7. A grinding and dispersing apparatus according to claim 5; wherein the rotational shaft extends through the aperture of the removable cover; and wherein the stirring mechanism has at least one rotationally driven element disposed in the container and integrally connected to the rotational shaft for rotation therewith.

8. A grinding and dispersing apparatus according to claim 7; wherein the feeding mechanism is integrally connected to the rotational shaft for rotation therewith.

9. A grinding and dispersing apparatus according to claim 7; wherein the rotationally driven element comprises a stirring blade.

10. A grinding and dispersing apparatus according to claim 7; wherein the at least one rotationally driven element comprises a plurality of rotationally driven elements.

11. A grinding and dispersing apparatus according to claim 10; wherein the plurality of rotationally driven elements comprise stirring blades.

12. A grinding and dispersing apparatus according to claim 10; wherein one of the plurality of rotationally driven elements is disposed closer to the separating device than the other rotationally driven elements and has a pitch which, during rotation, causes the grinding media in the container to move upwardly towards the other rotationally driven elements.

13. A grinding and dispersing apparatus according to claim 1; wherein the feeding mechanism comprises a feeding screw.

14. A grinding and dispersing apparatus according to claim 1; wherein the feeding mechanism comprises a feeding blade.

15. A grinding and dispersing apparatus according to claim 1; wherein the separating device comprises a filter member having a base portion defining a base of the container, and peripheral sections extending from the base portion and connected to the container.

16. A grinding and dispersing apparatus according to claim 15; wherein each of the peripheral sections of the filter member has a length equal to or less than ⅓ of a height of the container.

17. A grinding and dispersing apparatus according to claim 15; further comprising a holding frame integrally connected to the container for removably supporting the filter member, the peripheral sections of the filter member being connected to the holding frame.

18. A grinding and dispersing apparatus according to claim 1; further comprising at least one stirring mechanism extending into the tank for circulating the liquid containing the material within the tank, the stirring mechanism being disposed between the container and an inner wall surface of the tank.

19. A grinding and dispersing apparatus according to claim 18; wherein the stirring mechanism extending into the tank comprises a rotational shaft extending into the tank, and a rotationally driven element disposed in the tank and integrally connected to the rotational shaft for rotation therewith.

20. A grinding and dispersing apparatus according to claim 19; wherein the rotationally driven element comprises a stirring blade.

21. A grinding and dispersing apparatus according to claim 18; wherein the at least one stirring mechanism comprises a plurality of stirring mechanisms equally spaced around the container.

22. A grinding and dispersing apparatus according to claim 21; wherein the plurality of stirring mechanisms comprise a pair of stirring mechanisms, the container being disposed between the pair of stirring mechanisms.

23. A grinding and dispersing apparatus according to claim 1; wherein the rotational shaft has a terminal end disposed in the container; and wherein the stirring mechanism has a rotationally driven element disposed in the container and connected to the terminal end of the rotational shaft for rotation therewith.

24. A grinding and dispersing apparatus according to claim 23; further comprising first stirring blades disposed in the container and connected to the rotational shaft for rotation therewith; and wherein the rotationally driven element comprises second stirring blades disposed closer to the separating device than the first stirring blades and having a pitch which, during rotation, causes the grinding media in the container to move upwardly towards the first stirring blades.

25. A grinding and dispersing apparatus according to claim 1; further comprising at least one stirring mechanism extending into the tank for circulating the liquid containing the material within the tank, the stirring mechanism being disposed between the container and an inner wall surface of the tank but not directly below the separating device.

26. A grinding and dispersing apparatus according to claim 1; further comprising at least one stirring mechanism extending into the tank for circulating the liquid containing the material within the tank, the stirring mechanism being disposed outside an extension of a rotational axis of the rotational shaft.

27. A grinding and dispersing apparatus comprising: first storing means for storing a liquid containing a material to be treated; second storing means disposed in the first storing means for storing grinding media, the second storing means having an inlet for receiving the liquid containing the material and a discharge outlet for discharging the liquid containing the material; feeding means for feeding the liquid containing the material into the second storing means; a stirring mechanism for stirring the grinding media in the second storing means and the liquid containing the material fed into the second storing means by the feeding means to disperse the material in the liquid, the stirring mechanism having a rotational shaft extending into the second storing means but not through the discharge outlet of the second storing means; and separating means for separating the grinding media from the liquid containing the material and permitting the liquid containing the material but not the grinding media to be discharged from the second storing means.

28. A grinding and dispersing apparatus according to claim 27; further comprising means disposed at least partly around the second storing means for receiving a temperature-controlling fluid to control the temperature of the liquid containing the material.

29. A grinding and dispersing apparatus according to claim 27; further comprising a removable cover disposed at the inlet of the second storing means, the removable cover having an aperture through which the liquid containing the material is fed into the second storing means by the feeding means.

30. A grinding and dispersing apparatus according to claim 29; wherein the stirring means includes means for circulating the liquid containing the material within the first storing means.

31. A grinding and dispersing apparatus according to claim 27; wherein the rotational shaft has a terminal end disposed in the second storing means; and wherein the stirring mechanism has a rotationally driven element disposed in the second storing means and connected to the terminal end of the rotational shaft for rotation therewith.

32. A grinding and dispersing apparatus according to claim 31; further comprising first stirring blades disposed in the second storing means and connected to the rotational shaft for rotation therewith; and wherein the rotationally driven element comprises second stirring blades disposed closer to the separating means than the first stirring blades and having a pitch which, during rotation, causes the grinding media in the second storing means to move upwardly towards the first stirring blades.

33. A grinding and dispersing apparatus according to claim 27; further comprising at least one stirring mechanism extending into the first storing means for circulating the liquid containing the material within the first storing means, the stirring mechanism being disposed between the second storing means and an inner wall surface of the first storing means but not directly below the separating means.

34. A grinding and dispersing apparatus according to claim 27; further comprising at least one stirring mechanism extending into the first storing means for circulating the liquid containing the material within the first storing means, the stirring mechanism being disposed outside an extension of a rotational axis of the rotational shaft.

35. A grinding and dispersing method comprising the steps of: storing a liquid containing a material to be treated in a tank; storing a grinding media in a container having an inlet for receiving the liquid containing the material and a discharge outlet for discharging the liquid containing the material; immersing the container in the tank; drawing the liquid containing the material to be treated into the container through the inlet thereof; agitating the grinding media and the liquid containing the material to be treated by rotating a rotational shaft having a plurality of stirring blades and extending into the container but not through the discharge outlet of the container to thereby grind and disperse the material to be treated in the liquid; and discharging only the liquid containing the dispersed material from the discharge outlet of the container while separating the grinding media from the liquid containing the dispersed material.

36. A grinding and dispersing method according to claim 35; wherein the drawing step comprises feeding the liquid containing the material to be treated in the tank into the container using a feeding screw.

37. A grinding and dispersing method according to claim 35; including the step of circulating the liquid containing the material to be treated within the tank.

38. A grinding and dispersing method according to claim 35; wherein during the discharging step, the grinding media is separated from the liquid containing the dispersed material by a separating device.

39. A grinding and dispersing method according to claim 38; wherein the separating device comprises a filter member disposed at the discharge outlet of the container; and wherein the separating step includes using the filter member to allow only the liquid containing the dispersed material to be discharged from the discharge outlet of the container.

40. A grinding and dispersing method according to claim 35; including the step of circulating the liquid containing the dispersed material through the tank and the container while repeating the moving step until the material is ground and dispersed to a preselected amount.

41. A grinding and dispersing method according to claim 35; including the step of controlling the temperature of the liquid containing the material to be treated.

42. A grinding and dispersing apparatus comprising: a tank for storing a liquid containing a material to be treated; a container disposed in the tank for containing grinding media, the container having an inlet for receiving the liquid containing the material and a discharge outlet for discharging the liquid containing the material; a feeding mechanism disposed at the inlet of the container for feeding the liquid containing the material into the container; a first rotational shaft having a plurality of stirring members extending into the container for stirring the grinding media and the liquid containing the material fed into the container to disperse the material in the liquid during rotation of the first rotational shaft; at least one second rotational shaft rotatable independently of the first rotational shaft and having a stirring member extending into the tank for circulating the liquid containing the material within the tank during rotation of the second rotational shaft; and a separating device disposed at the discharge outlet of the container for separating the grinding media from the liquid containing the dispersed material and permitting the liquid containing the dispersed material but not the grinding media to be discharged from the container.

43. A grinding and dispersing apparatus according to claim 42; wherein the separating device comprises a removable filter member supported by the container at the discharge outlet thereof.

44. A grinding and dispersing apparatus according to claim 43, further comprising a holding frame integrally connected to the container for removably supporting the filter member.

45. A grinding and dispersing apparatus according to claim 42; wherein the first rotational shaft extends into the container but not through the discharge outlet of the container.

46. A grinding and dispersing apparatus according to claim 42; further comprising a jacket disposed inside of the tank and over a peripheral wall portion of the container for receiving a temperature-controlling fluid to control the temperature of the liquid containing the material.

47. A grinding and dispersing apparatus according to claim 42; wherein the peripheral wall portion of the container is imperforate.

48. A grinding and dispersing apparatus comprising: a tank for storing a liquid containing a material to be treated;

a container disposed in the tank for containing grinding media, the container having an inlet for receiving the liquid containing the material and a discharge outlet for discharging the liquid containing the material; a filter member disposed at the discharge outlet of the container for separating the grinding media from the liquid containing the material; a holding frame integrally connected to the container for removably supporting the filter member; a drive shaft extending axially through the inlet of and into the container but not through the filter member; and a plurality of stirring members integrally connected to and driven by the drive shaft for stirring the grinding media and the liquid containing the material fed into the container to disperse the material in the liquid.

* * * * *